US005915635A

United States Patent [19]

Cannell et al.

[11] Patent Number: 5,915,635

[45] Date of Patent: Jun. 29, 1999

[54] JET MILLING OF AGRICHEMICAL FEEDSTOCKS

[75] Inventors: Kenneth Wayne Cannell; Walter Lynn Harvick, both of Yuma, Ariz.

[73] Assignee: Gowan Milling Company, L.L.C., Yuma, Ariz.

[21] Appl. No.: 08/718,008

[22] Filed: Sep. 13, 1996

[51] Int. Cl.[6] ..... B02C 19/00

[52] U.S. Cl. ..... 241/5; 241/24.1; 241/39; 241/79.1

[58] Field of Search ..... 241/1, 5, 24.1, 241/39, 79.1

[56] References Cited

U.S. PATENT DOCUMENTS

| | | | |
|---|---|---|---|
| 1,935,344 | 11/1933 | Andrews et al. | 241/39 |
| 2,932,458 | 4/1960 | Croft et al. | 241/80 X |
| 3,477,650 | 11/1969 | Williams | 241/47 |
| 3,602,164 | 8/1971 | Reintjes | 110/106 |
| 3,610,594 | 10/1971 | Williams | 263/15 |
| 3,877,647 | 4/1975 | Gorobets et al. | 241/39 |

*Primary Examiner*—John M. Husar
*Attorney, Agent, or Firm*—Antonio R. Durando

[57] ABSTRACT

A system for reducing the particle size of particulate substances and classifying the resulting particles includes a compressor, a jet mill and a series of separators. The compressor is connected to the jet mill by a feed pipe, and a hopper for particulate substances discharges into the feed pipe. The compressor, jet mill and separators are arranged in series and a recirculating pipe runs from the last separator back to the compressor. The compressor is driven by a combustion engine having an outlet for exhaust gases. The outlet is connected to the recirculating pipe by way of a catalytic converter and a cooling unit. The catalytically converted exhaust gases provide an inert atmosphere for the jet mill and function as a carrier for particulate substances admitted into the feed pipe.

22 Claims, 1 Drawing Sheet

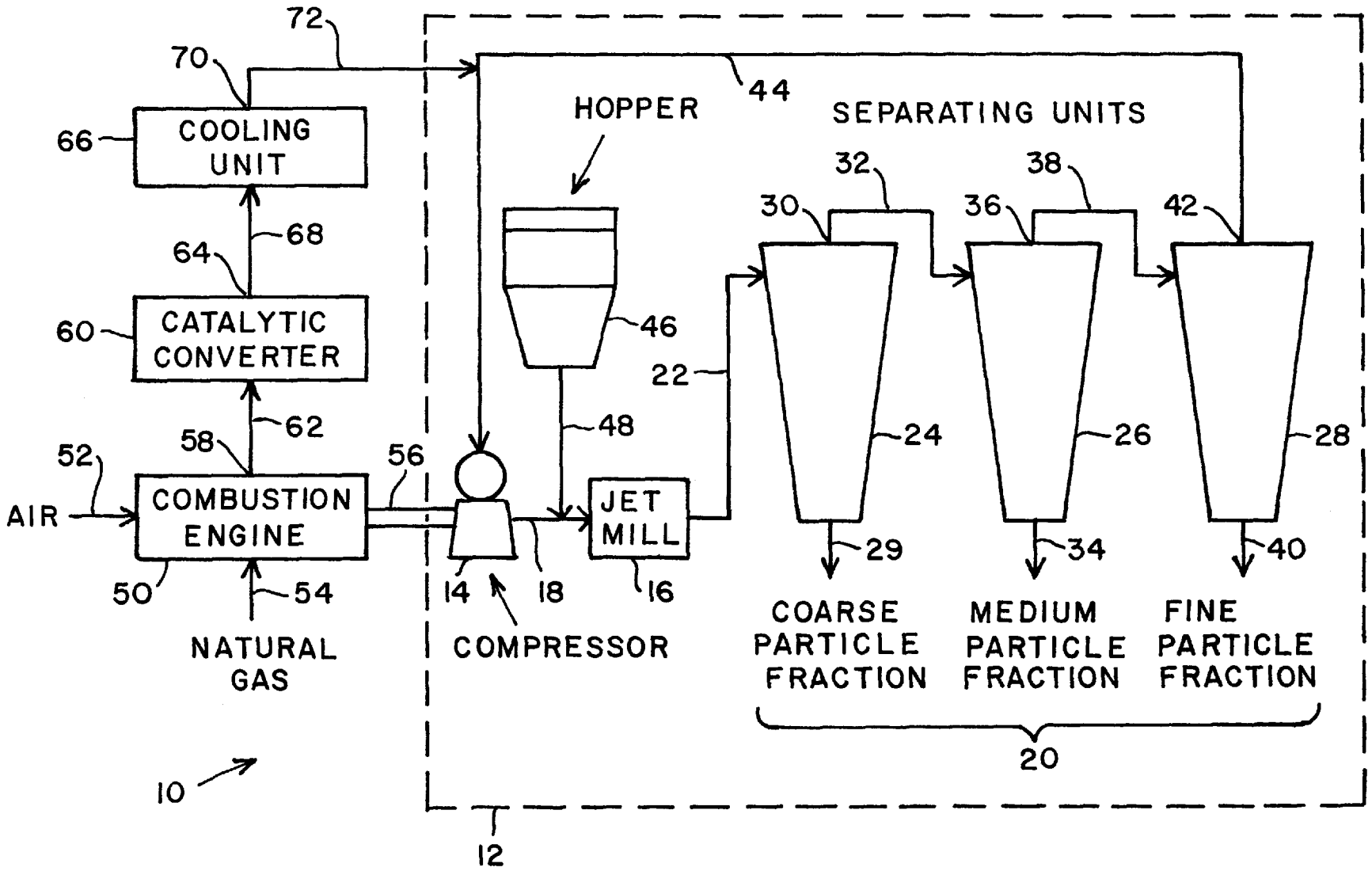
SEPARATING UNITS
HOPPER
JET MILL
COMPRESSOR
COARSE PARTICLE FRACTION
MEDIUM PARTICLE FRACTION
FINE PARTICLE FRACTION
COOLING UNIT
CATALYTIC CONVERTER
COMBUSTION ENGINE
NATURAL GAS
AIR
10
12
14
16
18
20
22
24
26
28
29
30
32
34
36
38
40
42
44
46
48
50
52
54
56
58
60
62
64
66
68
70
72

JET MILLING OF AGRICHEMICAL FEEDSTOCKS

BACKGROUND OF THE INVENTION

1. Field of the Invention

The invention relates to the mechanical and/or chemical processing of substances.

2. Description of the Prior Art

When the particle size of a substance is mechanically reduced, sparks may be generated. This poses the threat of an explosion if the substance is combustible. The chance of an explosion increases with decreasing particle size because small particles ignite more readily than large ones.

In order to reduce the possibility of an explosion, U.S. Pat. Nos. 3,477,650; 3,602,164; and 3,610,594 propose to reduce particle size in an air atmosphere which is deficient in oxygen. To this end, air and fuel are combusted in a furnace to reduce the oxygen content of the air which then forms the atmosphere for particle reduction.

The method of the above patents requires a special furnace which increases the cost of the system used for the method.

SUMMARY OF THE INVENTION

It is an object of the invention to provide a processing system which can be made relatively economically.

Another object of the invention is to provide a processing method which can be performed using a relatively inexpensive system.

The preceding objects, as well as others which will become apparent as the description proceeds, are achieved by the invention.

One aspect of the invention resides in a processing system. The system comprises an apparatus, including a powered device, for treating a substance as well as a combustion engine for driving the device. The system further comprises means for admitting a combustion product of the engine into the apparatus.

In accordance with the invention, a combustion engine which drives a component of a processing system also supplies a relatively inert product to the system. Thus, the combustion products of a combustion engine contain oxygen mostly in a form which does not readily support ignition. Since the combustion engine performs the function of supplying a relatively inert combustion product to the system, no special furnace is required for this purpose.

Another aspect of the invention resides in a processing method. The method comprises the steps of generating energy, by combustion, for a treatment of a substance, and employing a product of the combustion for the treatment. The substance can, for example, be a feedstock for an agrichemical.

The combustion is preferably carried out using natural gas.

The method may further comprise the step of feeding the substance to be treated into a treating chamber. The step of employing the combustion product for the treatment then involves introducing the product into the chamber.

The method can also comprise the step of compressing the combustion product prior to employing the same for the treatment. If the substance to be treated is particulate, the step of employing the combustion product for the treatment may include entraining the substance with the product after the compressing step, and thereafter impacting a surface with the substance to decrease the particle size of the latter.

The method may additionally comprise the step of catalytically converting the combustion product prior to employment of the product for the treatment. Moreover, the method can include the step of cooling the product and such step is likewise carried out before employing the product for the treatment.

The treatment may be performed in a portion of an endless path and at least part of the combustion product is then circulated in this path.

The substance to be treated can be subjected to centrifugal force and this is advantageously done while the substance is entrained by the combustion product. If the substance is particulate, the operation of subjecting the same to centrifugal force may involve separating particles of different size from one another.

Additional features and advantages of the invention will be forthcoming from the following detailed description of specific embodiments when read in conjunction with the accompanying drawing.

BRIEF DESCRIPTION OF THE DRAWING

The sole FIGURE schematically illustrates a processing system in accordance with the invention.

DESCRIPTION OF THE PREFERRED EMBODIMENTS

Referring to the single FIGURE, the reference numeral 10 generally denotes a processing system according to the invention. The processing system 10 is designed to reduce the particle size of particulate substances and to classify the particles obtained upon reduction.

The processing system 10 comprises a processing apparatus 12 delineated by a box drawn in broken lines. The processing apparatus 12 includes a compressor 14 which is connected to a milling or reducing unit 16 by way of a pipe or conduit 18. The milling unit 16, which functions to reduce the particle size of particulate substances, is preferably a jet mill as indicated. The jet mill 16, which defines a treating or reducing chamber, is connected to a classifying section 20 of the apparatus 12 via a pipe or conduit 22. The classifying section 20 has three classifying or separating units 24, 26 and 28 which can, for instance, be constituted by cyclone separators.

The separating unit 24 is provided with a solids outlet 29 for the discharge of a coarse particle fraction. The separating unit 24 is further provided with a gas outlet 30 through which a carrier gas with entrained medium and fine particles is withdrawn from the separating unit 24. The gas outlet 30 is connected to the separating unit 26 by way of a pipe or conduit 32.

The separating unit 26 has a solids outlet 34 which serves for the withdrawal of a medium particle fraction from the separating unit 26. The separating unit 26 also has a gas outlet 36 for removal of the carrier gas which now entrains fine particles only. The gas outlet 34 is connected to the separating unit 28 through a pipe or conduit 38.

The separating unit 28 is provided with a solids outlet 40 for the withdrawal of a fine particle fraction. The separating unit 28 is additionally provided with a gas outlet 42 for discharge of the carrier gas which, at this time, has been mostly cleansed of particles. The gas outlet 42 is connected to the compressor 14 via a pipe or conduit 44. Thus, the processing apparatus 12 defines an endless path for recirculation of the carrier gas.

A hopper or storage bin 46 contains a supply of a particulate substance to be treated in the processing apparatus 12. The particulate substance is here assumed to be a feedstock for an agrichemical. The hopper 46 is connected to the pipe 18, which joins the compressor 14 and the jet mill 16, by way of a pipe or conduit 48.

In addition to the processing apparatus 12, the processing system 10 comprises an engine 50 for driving or powering the compressor 14. The engine 50 is a combustion engine having an inlet 52 for air and an inlet 54 for fuel. Preferably, the engine 50 is capable of running on natural gas. A linkage 56 connects the engine 50 to the compressor 14.

The engine 50 is provided with an outlet 58 for exhaust gases, and the exhaust outlet 58 is connected to a catalytic converter 60 through a pipe or conduit 62. The catalytic converter 60 has an outlet 64 which is connected to a cooling unit 66 via a pipe or conduit 68. The cooling unit 66 which can, for instance, be equipped with spray heads, is provided with an outlet 70. The outlet 70 is connected to the conduit 44, which joins the separating unit 28 and the compressor 14, by way of a pipe or conduit 72.

The operation of the processing system 10 is as follows:

Air and natural gas are fed to the engine 50 which is started. The natural gas combusts in the engine 50 to yield carbon monoxide and nitrogen oxides. These gaseous combustion products are exhausted from the engine 50 to the catalytic converter 60. In the catalytic converter 60, the carbon monoxide and nitrogen oxides are catalytically converted into nitrogen and carbon dioxide. The nitrogen and carbon dioxide, which constitute inert gases, travel from the catalytic converter 60 to the cooling unit 66 where they are cooled. Following cooling the inert combustion gases are introduced into the pipe 44 connecting the separating unit 28 to the compressor 14.

The compressor 14 is running and the inert combustion gases entering the pipe 44 are drawn into the compressor 14 and compressed. The compressor 14 forces the inert combustion gases through the jet mill 16 and the separating units 24,26,28 back into the pipe 44 from which they reenter the compressor 14.

Once the inert combustion gases have established an inert atmosphere in the jet mill 16 and the pipe 18 leading from the compressor 14 to the jet mill 16, the feedstock particles in the hopper 46 are fed into the pipe 18. The feedstock particles are entrained by the stream of inert combustion gases flowing through the pipe 18 and injected into the jet mill 16. The feedstock particles impact the internal surfaces of the jet mill 16 at high speed thereby causing the feedstock particles to undergo a reduction in size. An additional reduction in size occurs by impact of the feedstock particles against one another. Due to the inert atmosphere provided by the inert combustion gases, there is virtually no danger that the feedstock particles will ignite if a spark is generated.

Feedstock particles which have been reduced to less than a predetermined size are entrained by the stream of inert combustion gases flowing out of the jet mill 16 and conveyed to the separating unit 24. In the separating unit 24, feedstock particles exceeding a first size are separated from the rest of the feedstock particles by centrifugal force and descend to the solids outlet 29 where they are discharged from the separating unit 24 as a coarse particle fraction.

The feedstock particles remaining after separation of the coarse particle fraction are carried out of the separating unit 24 by the stream of inert combustion gases flowing through the gas outlet 30. These remaining feedstock particles enter the separating unit 26 where feedstock particles larger than a second size are separated from smaller feedstock particles by centrifugal force. The larger feedstock particles travel down to the solids outlet 34 and are withdrawn from the separating unit 26 as a medium particle fraction.

The smaller feedstock particles are conveyed out of the separating unit 26 by the stream of inert combustion gases leaving through the gas outlet 36. The smaller feedstock particles are carried into the separating unit 28 where virtually all of the particles are collected at the solids outlet 40 and removed from the separating unit 28 as a fine particle fraction.

The cleansed inert combustion gases flow out of the separating unit 28 via the gas outlet 42 and travel through the pipe 44 back to the compressor 14. In the compressor 14, the cleansed inert combustion gases are compressed once again. The cleansed inert combustion gases are then recirculated.

Since a portion of the inert combustion gases is lost from the processing apparatus 12, fresh inert combustion gases from the engine 50 may be continuously supplied to the processing apparatus 12.

The inert combustion gases serve as a carrier for the feedstock particles.

The impacts caused in the jet mill 16 by the feedstock particles can produce sparks which, in an air atmosphere, may lead to an explosion. Thus, it is desirable to have an inert atmosphere in the jet mill 16. In the processing system 10 of the invention, the engine 50 serves the dual function of driving the compressor 14 and generating such an inert atmosphere. This allows simplification to be achieved since a separate source of an inert atmosphere is unnecessary.

Various modifications are possible within the meaning and range of equivalence of the appended claims. For example, the invention is applicable to processes other than particle size reduction and classification.

We claim:

1. A processing system comprising:

an apparatus for processing a substance with a working medium, said apparatus including a powered device for compressing the working medium;

a combustion engine for driving said powered device; and means for admitting a combustion product of said combustion engine into said powered device;

wherein the working medium comprises the combustion product of the combustion engine.

2. The system of claim 1, wherein said apparatus comprises a treating chamber for said substance and said admitting means is designed to admit the combustion product into said chamber.

3. The system of claim 1, wherein said powered device comprises a compressor.

4. The system of claim 3, wherein said apparatus further comprises a reducing device for decreasing the particle size of a particulate substance, a conduit between said compressor and said reducing device for introducing the compressed working medium from said compressor into said reducing device, and means for feeding the particulate substance into said conduit.

5. The system of claim 4, wherein said reducing device at least in part constitutes a jet mill.

6. The system of claim 3, wherein said admitting means is designed to admit the combustion product into said compressor.

7. The system of claim 1, wherein said engine is operable with natural gas.

8. The system of claim 1, further comprising a catalytic converter for processing said combustion product prior to admittance into said apparatus.

9. The system of claim 1, further comprising a cooler for cooling said combustion product prior to admittance into said apparatus.

10. The system of claim 1, wherein said apparatus comprises means for recirculating the combustion product.

11. The system of claim 1, wherein said apparatus further comprises a classifying device for separating particles of different size from one another.

12. The system of claim 1, further comprising a supply vessel containing a feedstock for an agrichemical.

13. A method of processing a substance in a substantially inert atmosphere, comprising the following sequential steps:

first, generating a working medium by combustion in a combustion engine;

second, compressing said working medium with a compressor driven by said combustion engine; and third, employing the working medium for processing a substance.

14. The method of claim 13, further comprising the step of feeding said substance into a treating chamber; and wherein the employing step comprises introducing said working medium into said chamber.

15. The method of claim 13, wherein said substance is particulate and the employing step comprises entraining said substance with said working medium after the compressing step, and thereafter impacting a surface with said substance to decrease the particle size of said substance.

16. The method of claim 13, wherein said combustion is performed with natural gas.

17. The method of claim 13, further comprising the step of catalytically converting said working medium prior to the employing step.

18. The method of claim 13, further comprising the step of cooling said working medium prior to the employing step.

19. The method of claim 13, wherein said processing is performed in a portion of an endless path and at least part of said working medium is circulated in said path.

20. The method of claim 13, wherein the employing step comprises entraining said substance with said working medium, and thereafter subjecting said substance to centrifugal force.

21. The method of claim 20, wherein said substance is particulate and the subjecting step comprises separating particles of different sizes from one another.

22. The method of claim 13, wherein said substance comprises a feedstock for an agrichemical.

* * * * *